US006799840B2

(12) United States Patent
Inamura

(10) Patent No.: US 6,799,840 B2
(45) Date of Patent: Oct. 5, 2004

(54) INK SUPPLY MECHANISM AND INKJET RECORDING APPARATUS INCLUDING THE INK SUPPLY MECHANISM

(75) Inventor: Shusuke Inamura, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/224,651

(22) Filed: Aug. 21, 2002

(65) Prior Publication Data

US 2003/0038865 A1 Feb. 27, 2003

(30) Foreign Application Priority Data

Aug. 22, 2001 (JP) ..... 2001-251483

(51) Int. Cl.[7] ..... B41J 2/175
(52) U.S. Cl. ..... 347/85
(58) Field of Search ..... 347/84, 85, 86, 347/87

(56) References Cited

U.S. PATENT DOCUMENTS 5,136,305 A * 8/1992 Ims ..... 347/85
5,874,976 A * 2/1999 Katon et al. ..... 347/85
6,076,920 A * 6/2000 Zapata et al. ..... 347/85
6,188,417 B1 * 2/2001 Keefe et al. ..... 347/86
6,199,975 B1 * 3/2001 Baitz et al. ..... 347/85
2003/0007045 A1 1/2003 Yoshida et al. ..... 347/86
2003/0007047 A1 1/2003 Otsuka et al. ..... 347/89
2003/0007048 A1 1/2003 Otsuka et al. ..... 347/89

* cited by examiner

*Primary Examiner*—Anh T. N. Vo
(74) *Attorney, Agent, or Firm*—Fitzpatrick, Cella, Harper & Scinto

(57) ABSTRACT

Disclosed is an ink supply mechanism comprising a first ink tank for storing ink; a joint portion connected to the first ink tank; and a second ink tank disposed to be movable to the first ink tank, being provided with a connection portion connected to the joint portion in order to make ink supply from the first ink tank possible, wherein the joint portion is movable between a connected position where the connection portion is connected thereto and a disconnected position where the connection portion is not connected thereto, and a cap member for sealing a region between the connection portion and the joint portion at both the connected position and the disconnected position is provided on the joint portion. Therefore, invasion of foreign materials into an ink path can be prevented when the joint portion and the second ink tank are connected to each other, and adherence of ink in the joint portion can also be prevented.

10 Claims, 6 Drawing Sheets

INK SUPPLY MECHANISM AND INKJET RECORDING APPARATUS INCLUDING THE INK SUPPLY MECHANISM

BACKGROUND OF THE INVENTION

1. Field of the Invention

The present invention relates to an inkjet recording apparatus wherein recording is carried out by discharging ink from a recording head, particularly to an ink supply mechanism between two ink tanks, which are connectable to and removable from each other via joint portions.

2. Related Background Art

Conventionally, there have been the following 3 types of system for supplying ink to a recording head of an inkjet recording apparatus.

(a) Head Cartridge System

As shown in FIG. 8, in the head cartridge system, a head cartridge 103, integrated with a recording head 101 for discharging ink and an ink tank 102 for storing ink to be supplied to the recording head 101, is mounted detachably on a carriage 104 which is supported slidably by a guide shaft 105. The carriage is reciprocated along the guide shaft 105 by a carriage drive mechanism, which is not shown in the FIG. 8. A platen 106 is disposed at a position opposite to the recording head 101, and a record sheet 107 such as paper and film is transferred on the platen 106 perpendicular to the moving direction of the carriage 104 by a record sheet transfer mechanism, which is not shown in the FIG. 8.

And then, while repeating intermittent supply (supplementary scanning) of the record sheet 107 and reciprocating motion (main scanning) of the carriage 104, desired letters and images are recorded on the record sheet 107 by driving the recording head 101 and discharging ink from the recording head 101, on the basis of recording signals. In this system, the ink in the ink tank 102 is supplied directly into the recording head 101.

(b) Tank Cartridge System

As shown in FIG. 9, in the tank cartridge system, only a recording head 111 is mounted on a carriage 114. A tank cartridge 112 for storing ink is disposed on a main body side of an ink jet recording apparatus. The recording head 111 and the tank cartridge 112 are connected each other with a flexible ink supply tube 113 which can follow the movement of the carriage 114 along a guide shaft 115, and the ink in the tank cartridge 112 is supplied into the recording head 111 via the ink supply tube 113.

(c) Pit-In System

As shown in FIG. 10, in the pit-in system, a recording head 121 and a sub-tank 122 are mounted on a cartridge 124. The recording head 121 and the sub-tank 122 are integrated in a one body, and the ink in the sub-tank is supplied directly into the recording head 121. On the other hand, a main tank 123, whose capacity of ink is larger than that of the sub-tank 122, is disposed on a main body side of an inkjet recording apparatus. On the main tank 123 provided is a joint portion 123*a*, which is communicated with an ink inlet portion 122*a* provided on the sub-tank 122 when the sub-tank is moved to the facing position against the main tank 123.

When the volume of the ink in the sub-tank 122 decreases less than the predetermined amount as a result of consumption of the ink in the sub-tank 122 by discharging ink from the recording head 121, a carriage 124 is moved along a guide shaft 125 to the position where the ink inlet portion 122*a* faces the joint portion 123*a*. At the position, the ink inlet portion 122*a* and the joint portion 123*a* are communicated with each other to supply ink from the main tank 123 into the sub-tank 122.

However, there have been problems shown below in the conventional system of supplying ink described above.

In the head cartridge system, it is essential to make a capacity of the ink tank larger in order to reduce exchange frequency of the head cartridge, namely, in order to increase the number of sheets, which can be recorded by a single head cartridge. Since the head cartridge is mounted on the carriage, however, the increase in capacity of the ink tank results in the increase in space necessary for scanning the carriage to thereby require the enlargement of a recording apparatus, and also results in uneasiness of high-speed carriage scanning due to larger weight applied to the carriage.

On the other hand, in the tank cartridge system, the above-mentioned problem is eliminated because the recording head is only mounted on the carriage. Since the recoding head is connected to the tank cartridge with the ink supply tube, however, a complicated mechanism becomes necessary resulting in uneasiness of miniaturization of a recording apparatus.

Besides, in the pit-in system, since ink is supplied from the main tank into the sub-tank and the volume of the sub-tank can be small, size and weight of the structure on the carriage become smaller than those in the head cartridge system, resulting in a simple configuration of the apparatus due to no more need of an ink supply tube.

However, in the pit-in system, since coupling portions between the main tank and the sub-tank (the ink inlet portion 122*a* and the joint portion 123*a* in the example shown in FIG. 10) are apart from each other during recording operation, foreign material such as paper powder and dust sticks and piles up onto the coupling portions during their usage for a long time. When the ink is supplied into the sub-tank from the main tank during their coupling, the piled-up foreign material is introduced into the coupling portions and may reach the recording head via the sub-tank. Once the foreign material reaches the recording head, discharge of the ink becomes unstable resulting in no discharge of the ink in the worst case.

Besides, sealing ability of the joint portion may decrease to introduce air into the coupling portions by piling up of the foreign material at the joint portion. Further, since the coupling portions are opened except when supplying ink, the ink filled in the coupling portions becomes dry to adhere as a solid to the interior of the coupling portions. Thus, as a result of introduction of air and adhesion of solid ink, flow resistance of ink in the coupling potions increases, and reliability of supplying ink decreases after all.

SUMMARY OF THE INVENTION

The object of the present invention is to provide an ink supply mechanism and an inkjet recording apparatus, wherein ink is supplied in high reliability still employing the pit-in system, which is able to supply ink by only a small and simple configuration.

Another object of the present invention is to provide an ink supply mechanism comprising a first ink tank for storing ink a joint portion connected to said first ink tank and a second ink tank disposed to be movable to said first ink tank and provided with a connection portion connected to said joint portion in order to make ink supply from said first ink tank possible, wherein said joint portion is movable between a connected position where said connection portion is connected thereto and a disconnected position where said connection portion is not connected thereto, and a cap member for sealing a region between said connection portion and said joint portion at both said connected position and said disconnected position is provided on said joint portion.

A still another object of the present invention is to provide an ink jet recoding apparatus for recording by means of discharging ink onto a record sheet from a recording head comprising a first ink tank provided in the recording apparatus for storing ink a joint portion connected to said first ink tank a second ink tank disposed to be movable against said first ink tank, being provided with a connection portion connected to said joint portion in order to make ink supply from said first ink tank possible and a carriage for reciprocating with the recording head and said second ink tank mounted thereon, wherein said joint portion is movable between a connected position where said connection portion is connected thereto and a disconnected position where said connection portion is not connected thereto, and a cap member for sealing a region between said connection portion and said joint portion at both said connected position and said disconnected position is provided on said joint portion.

DETAILED DESCRIPTION OF THE PREFERRED EMBODIMENTS

Figure 1:
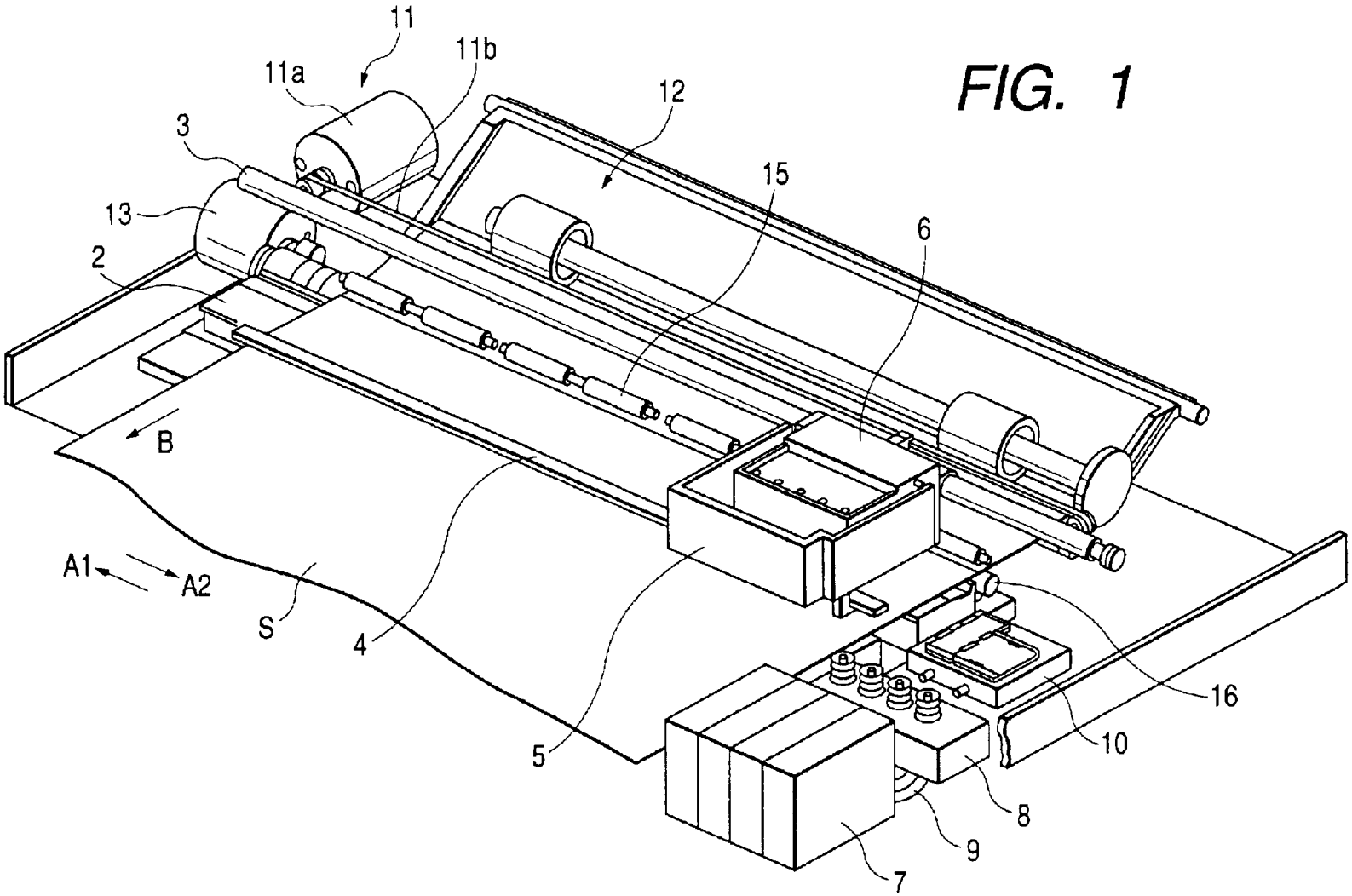
FIG. 1 is a schematic perspective view of an inkjet recording apparatus according to the first embodiment of the present invention.

Next, the embodiments of the present invention will be described referring to the drawings.

(The First Embodiment)

FIG. 1 is a schematic perspective view of an inkjet recording apparatus according to the first embodiment of the present invention.

As shown in FIG. 1, a carriage 5, on which a head cartridge 6 is detachably mounted, is supported slidably by a guide shaft 3 and a guide rail 4 disposed parallel to each other. The head cartridge 6, as described later in detail, is integrally composed of a recording head portion for discharging ink on the basis of recording signals and a sub-tank portion for storing ink to be supplied into the recording head portion. The inkjet recording apparatus of the present embodiment can record in full color using black ink, yellow ink, magenta ink and cyan ink, and the recording head portion and the sub-tank portion are provided corresponding to each color of the ink.

A carriage drive mechanism 11 includes a timing belt 11*b* put around two pulleys and a carriage motor 11*a* for rotating one of the two pulleys. The carriage 5 is fixed to a portion of the timing belt 11*b*, and the carriage 5 is disposed to reciprocate along a guide shaft 3 in the direction of arrows A1 and A2 (main scanning direction) through rotating the timing belt 11*b* by the carriage motor.

As a record sheet S, various media used in inkjet recording such as paper and film are applicable. The record sheet is transferred toward the front side from the back side of the inkjet recording apparatus in the direction of arrow B (supplementary scanning direction), that is, the direction crossing the moving direction of the carriage 5 (the perpendicular direction in the present embodiment).

In the transfer path of the record sheet, included are a transfer roller 16 being rotated by a sheet-feed motor 13, a pinch roller 15 pressed against the transfer roller 16 by an urging means such as a spring (not depicted in the figure), a sheet-feed portion 12 for feeding sheet by sheet the record sheet S between the transfer roller 16 and the pinch roller 15, a platen 2 disposed a predetermined space apart opposite to a recoding head portion of the head cartridge 6 within the range of the movement of the carriage 5, and an ejection roller and a spur (not depicted in the figure) disposed on a downstream side of the carriage 5 as to the transfer direction of the record sheet S for ejecting (or discharging) the record sheet S out of the inkjet recording apparatus pinching the record sheet S between them.

At the position within the range of the movement of the carriage 5 and yet without the region through which the record sheet S passes, provided is a head cap 10 for capping a surface (an ink discharge surface), from which ink is discharged, of the recording head portion of the head cartridge 6 at the time of non-recording. The position of the carriage 5, at which the head cap 10 can execute the capping, is referred to as the home position.

Further, a plurality of main tanks 7 containing respective color inks to be supplied into the head cartridge 6 are provided at appropriate positions in the inkjet recording apparatus. Each main tank is connected to a join portion 8 via a tube 9. The joint portion 8 is provided at the position facing the sub-tank portion of the head cartridge 6 in order to be connected to the head cartridge 6 when the carriage 5 is located at the home position, and the ink in the main tank 7 is got ready to be supplied into the sub-tank portion of the head cartridge 6 via the tube 9 and the joint portion 8 as a result of connecting the joint portion 8 to the head cartridge 6.

Figure 2:
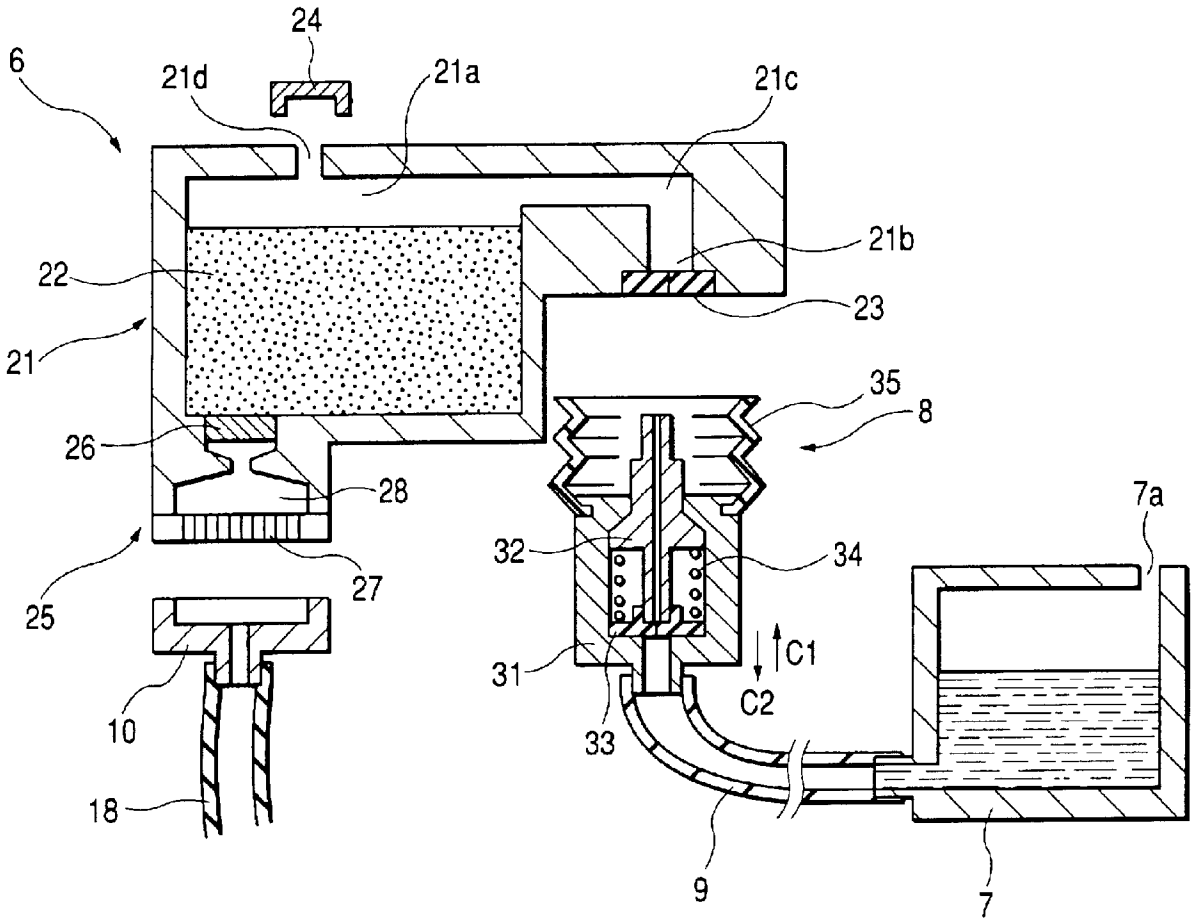
FIG. 2 is a sectional view of a head cartridge, a joint portion, etc. of the inkjet recording apparatus shown in FIG. 1 at a retreated position.

Now, configurations of the head cartridge 6 and the joint portion 8 are described in detail referring to FIG. 2.

In FIG. 2, shown is a sectional view of the joint portion 8 and the head cartridge 6 for only one color under an unconnected state to each other and also under an uncapped state by the head cap 10 while the carriage is located at the home position. Further, the carriage is omitted in FIG. 2.

The head cartridge includes the sub-tank portion 21 and the recording head portion 25 as before-mentioned.

In the interior of the sub-tank 21, provided is an ink container 21*a* including a negative pressure generation member 22. The negative pressure generation member 22 is composed of a porous body or an assembly of fiber comprising e.g. polypropylene, and holds ink under a negative pressure generated by capillary force. Besides, in the sub-tank portion 21, formed are an ink inlet 21*b* connected to the joint portion 8 and a sub-tank air vent 21*d* for communicating the interior of the ink container 21*a* with open air.

The ink inlet 21*b* is communicated with the ink container 21*a* via an ink flow path 21*c* and is stopped with a rubber plug 23 where a slit is formed for inserting and drawing out an upper end portion of a supply tube 32 of the joint portion 8, and thereby shut off is the interior of the sub-tank 21 from the exterior. The sub-tank air vent 21*d* can be opened and shut with a sub-tank valve 24 actuated by a driving means, which is not shown in the figure.

The recording head portion 25 is communicated with a plurality of nozzles 27 for discharging ink via the ink container 21*a* and a filter 26, and includes a liquid chamber 28 temporarily holding ink to be supplied into each nozzle. In the present embodiment, the recording head portion 25 employs such type of inkjet recording system as hereinbelow. In the system, provided is a device for generating heat energy to be utilized as the energy to discharge ink from the nozzles 27, and that the ink is discharged from a discharge outlet as an open end of the nozzle 27, due to creating state-change of the ink with the thermal energy generated by the device.

Using this type of system, high density and high definition recording of letters and images have been achieved. Especially in the present embodiment, an exothermic resistor element (an electro-thermal converter) as the element for generating thermal energy is included within the nozzle 27, and the ink is discharged from the discharge outlet utilizing pressure of bubbles created when the ink in the nozzle 27 is film-boiled by heating with the exothermic resistor element.

In the present invention, the system for discharging ink is not confined thereto, and such a system can be employed that the ink is discharged utilizing pressure of vibration due to the mechanical vibration energy given to the ink using an electro-mechanical conversion element such as a piezoelectric element.

Additionally, the ink in the recording head portion 25 can be forcedly sucked by a suction means such as a pump (not shown in the figure) via a suction tube 18 with the ink discharge surface capped with the head cap 10.

On the other hand, the joint portion 8 includes a joint base 31 holding the supply tube 32. The joint base 31 is disposed to be movable, by a driving means not shown in the figure, in the direction of arrow C1, which is the direction for approaching the ink inlet 21*b* of the head cartridge 6, and also in the direction of C2, which is the direction for going away from the ink inlet 21*b* (the up-and-down directions in the embodiment shown in the figure). The tube 9 connecting the main tank 7 and the joint portion 8 is connected to an end portion on a arrow C2 side of the joint base 31. Further, in the main tank 7 provided is a main tank air vent 7*a* communicating the interior and exterior of the main tank 7 in order to maintain the pressure in the main tank at the atmospheric pressure.

The supply tube 32 is a member through which ink flows during supply of ink from the main tank to the head cartridge 6, and is held against the joint base 31 free to slide in the directions of the arrows C1 and C2 in order for an upper end portion as an end portion on the ink inlet 21*b* side, to protrude always from the joint base 31. A plug 33 made of rubber is provided under the supply tube 32, and by the plug 33 prevented is the flow of the ink from the main tank 7 into the supply tube 32. A slit is formed on the plug 33 for inserting and drawing out a lower end portion of the supply tube 32 therethrough, and the lower end portion of the supply tube 32 can be protruded from the plug 33 through movement of the supply tube 32 in the arrow C2 direction within the joint base 31.

The upper end portion and the lower end portion of the supply tube 32 are made smaller in diameter than other portions, and only the two portions can be inserted into the plugs 23, 33 via the slits. Further, the lengths of the portions, with small outer diameters, of the upper end portion and the lower end portion of the supply tube 32 are longer than the corresponding thicknesses of the plugs 23, 33, respectively.

A flange portion is integrally formed in the middle portion of the supply tube 32, and the supply tube 32 is urged in the arrow C1 direction by a spring 34 provided in the joint base 31, and the range of movement of the supply tube 32 in the direction urged by the spring 34 is restricted within the joint base 31.

At an end portion, from which the supply tube 32 is protruded, of the joint base 31, provided is a cap 35. The cap 35 seals the region between the plug 23 and the joint portion 8 before the supply tube 32 contacts the plug 23, and is also a member surrounding the protruded portion of the supply tube 32 from the upper face of the joint base 31. Further, the cap 35 is made of an elastic material such as rubber in order to be compressed due to further movement of the joint base 31 in the arrow C1 direction, after abutting of the upper end of the cap against the head cartridge 6. In the present embodiment, the cap is composed of a rubber member molded in the shape of a bellows, and hardness thereof is chosen between 20 to 40 in type-A durometer hardness specified by JIS K 6250.

Next, described is the recording operation of the inkjet recording apparatus of the present embodiment.

During the recording operation, as shown in FIG. 2, the capping of the recording head portion 25 with the head cap 10 is released, and the sub-tank valve 24 also makes the sub-tank air bent 21*d* open. Further, the joint portion 8 is at the lowered position apart from the head cartridge 6. That is to say, the plug 23 on the sub-tank 21 side is stopped. Such a position of the joint portion 8, that the joint portion 8 is apart from the head cartridge 6, is referred to as the retreated position in the present specification.

In such a situation, the record sheet S fed, sheet by sheet, from the sheet-feed portion 12 is transferred between the head cartridge 6 and the platen 2, being pinched between the transfer roller 16 and the pinch roller 15, by rotation of the transfer roller 16.

Once the record sheet is transferred to a predetermined position, the transfer of the record sheet is stopped, the carriage is moved, the ink is discharged from the recording head portion 25 of the head cartridge 6 on the basis of recording signals synchronized therewith, and the recording by one column is executed on the record sheet S. Then, transferring the record sheet S by a predetermined pitch, the recording of the next column is executed while the carriage 5 is being moved again. In the following, by repeating alternately the main scanning of the head cartridge 6 and the sub-scanning of the record sheet S by the predetermined pitch, recording of the desired letters and images is executed on the record sheet S.

The record sheet already recorded is, after passing through the platen 2, ejected out of the inkjet recording apparatus being pinched between the ejecting roller and the spur.

Figure 3:
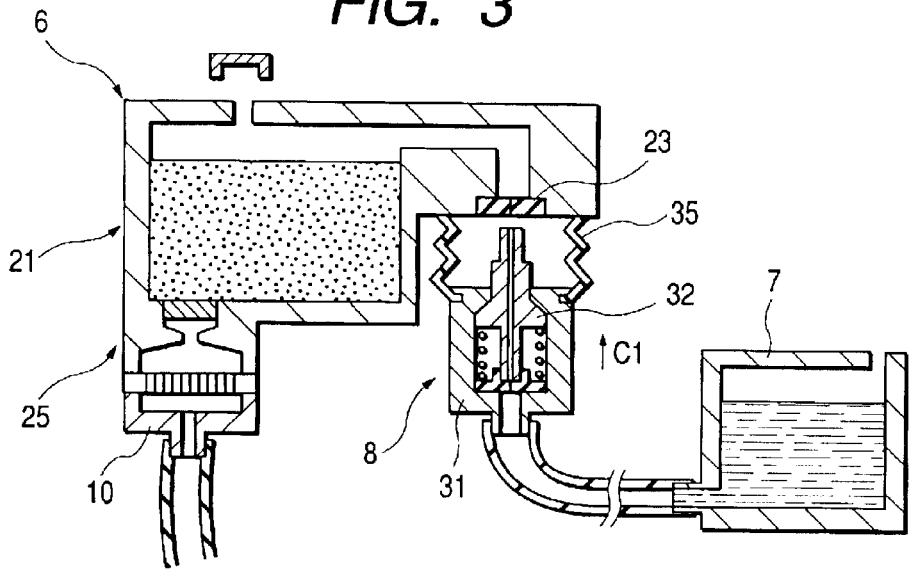
FIG. 3 is a sectional view at a sealed position transferred by lifting a joint base from the state shown in FIG. 2.

Once recording is finished as described above, the carriage 5 returns to the home position. Then, as shown in FIG. 3, while capping the recording head portion 25 with the head cap 10 is executed, the joint base 31 is raised up, namely, moved in the arrow C1 direction, and the cap 35 is pressed to a portion around the plug 23 of the head cartridge 6. Moreover, the situation shown in FIG. 3 is maintained after the power supply of the inkjet recording apparatus is switched off. Further, in this situation, although the supply tube 32 is not inserted through the plug 23 and the joint portion 8 is not communicated with the sub-tank portion 21, such a position of the joint portion 8, that the region between the plug 23 and the joint portion 8 is so sealed by the cap 35, is referred to as the sealed position in the present specification.

Thus, while recording is not executed, the connected portion between the plug 23 and the supply tube 32 is sealed by pressing the cap 35 to the head cartridge 6. Thereby, protected is adhesion and pile-up of foreign materials such as dust on the plug 23 and the supply tube 32, and when the head cartridge 6 and the joint portion 8 are connected (as after-described), invasion of foreign materials into the ink supply path from the main tank 7 to the head cartridge 6 can be prevented.

Further, drying of the ink in the supply tube 32 and adherence of the ink in the supply tube 32 are prevented by sealing the region between the plug 23 and the supply tube 32 with the cap 35. Thereby, reliability of supplying ink from the main tank 7 to the head cartridge 6 can be enhanced.

Moreover, since the joint portion 8 is disposed to be able to take the retreated position in addition to the sealed position in the present embodiment, interference of the head cartridge 6 with the cap 35 can be prevented when the carriage 6 returns to the home position after finishing recording operation and when it moves out of the home position to start recording operation. Although in the present embodiment the shape of a bellows is shown as the shape of the cap 35, it is not confined thereto so long as it may seal the region between the plug 23 and the supply tube 32.

At the sealed position, when the remainder of ink in the sub-tank 21 is small due to consumption of the ink in the recording head portion 25, ink is supplied from the main tank 7 into the sub-tank portion 21. Detection of the remainder of the ink in the sub-tank portion 21 can be executed on the basis of the number of operations of the recording head portion 25 as well as on the basis of the detected results by an ink remainder sensor, which is disposed in the sub-tank portion 21.

When ink is supplied from the main tank 7 into the sub-tank portion 21, the joint base 31 is raised up further from the sealed position. Although the cap 35 is thereby compressed, influence upon the driving load during the rise of the joint base 31 can be suppressed at a minimum, because the cap 35 can be smoothly compressed by a small load, owing to the cap 35 having the shape of a bellows and being made of an elastic member with hardness between 20 to 40 in type A durometer hardness specified by JIS K 6250.

Figure 4:
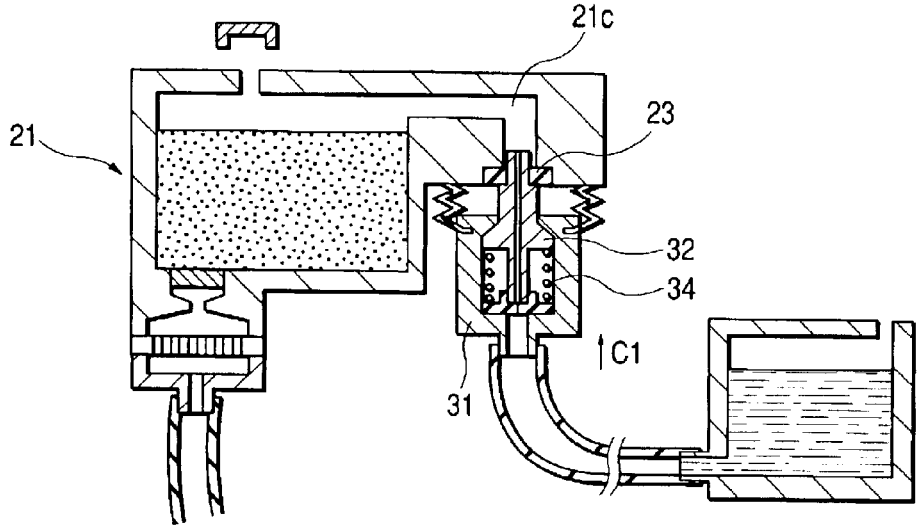
FIG. 4 is a sectional view with the joint portion and a sub-tank communicated between them by lifting the joint base higher than the state shown in FIG. 3.

And, when the joint base 31 is further raised up, as shown in FIG. 4, the upper end portion of the supply tube 32 is inserted into the plug 23 via the slit, going through the plug 23 into the ink flow path 21*c* of sub-tank portion 21, and the supply tube 32 is communicated with the sub-tank portion 21. Although the supply tube 32 is applied with a repulsive force by the plug 23 when the supply tube 32 passes through the plug 23, the supply tube 32 can pass through the plug 23 with no resistance to the urging strength of the spring 34, because the urging strength of the spring 34 is set larger than the repulsive force applied to the supply tube 32 by the plug 23.

Figure 5:
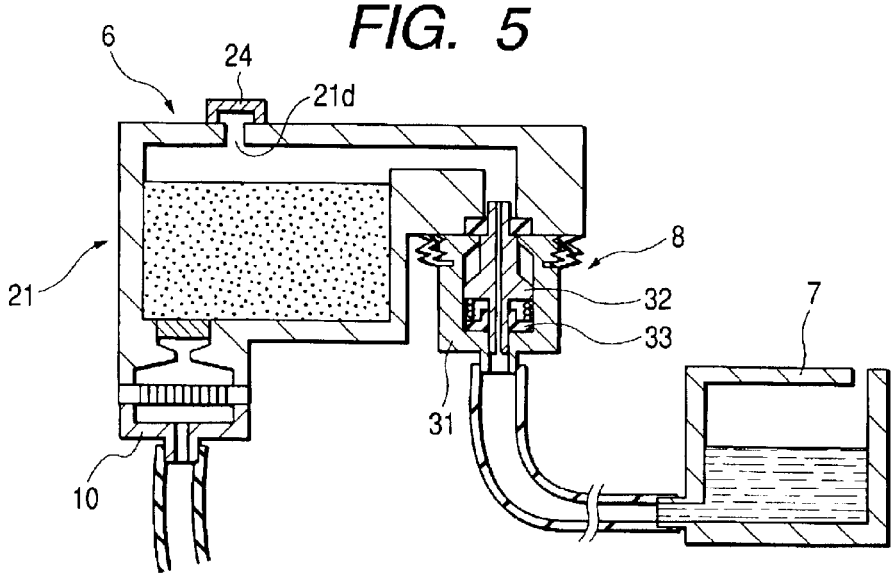
FIG. 5 is a sectional view with the joint portion and a main tank communicated between them by lifting the joint base higher than the state shown in FIG. 4.

Once the portion smaller in diameter of the upper end portion of the supply tube 32 is completely into the plug 23, the supply tube 32 is not inserted any more against the plug 23. Therefore, the position of the supply tube does not change even though the joint base 31 is raised up further. That is to say, the supply tube 32 falls down relatively to the joint base 31 resisting the urging strength of the spring 34. Thereby, as shown in FIG. 5, the lower end portion of the supply tube is urged into the plug 33 via a slit to pass through the plug 33. For the first time, at this point, the main tank 7 communicates with the supply tube 32, and the main tank 7 is connected to the head cartridge 6 via the joint portion 8. Finally, the joint base 31 is raised up until it contacts the head cartridge 6.

When the main tank 7 and the head cartridge 6 are thus connected, the sub-tank air vent 21*d* of the sub-tank portion 21 is closed by the sub-tank valve 24. Once the negative pressure in the head cartridge 6 is lowered by a suction means via the head cap 10 in the above-mentioned situation, ink is supplied from the main tank 7 into the sub-tank portion 21 due to this negative pressure.

As described above, by employing such a configuration that the main tank 7 is communicated with the joint portion 8 at the last step of the procedure when the main tank 7 is connected to the sub-tank portion 21 via the joint portion 8, leakage of ink on the main tank side can be prevented, even though the above-mentioned connecting operation of the main tank 7 and the sub-tank portion 21 is stopped on the way due to power failure or breakdown.

Once ink supply into the sub-tank portion 21 is finished, the joint portion 8 is lowered. Thereby, following inversely the sequence of operations described above, first of all, the main tank 7 and the joint portion 8 are disconnected, then the head cartridge 6 and the joint portion 8 are disconnected. And, when subsequent recording is executed, the joint portion 8 is further lowered to separate the cap 35 from the head cartridge 6.

(The Second Embodiment)

Figure 6:
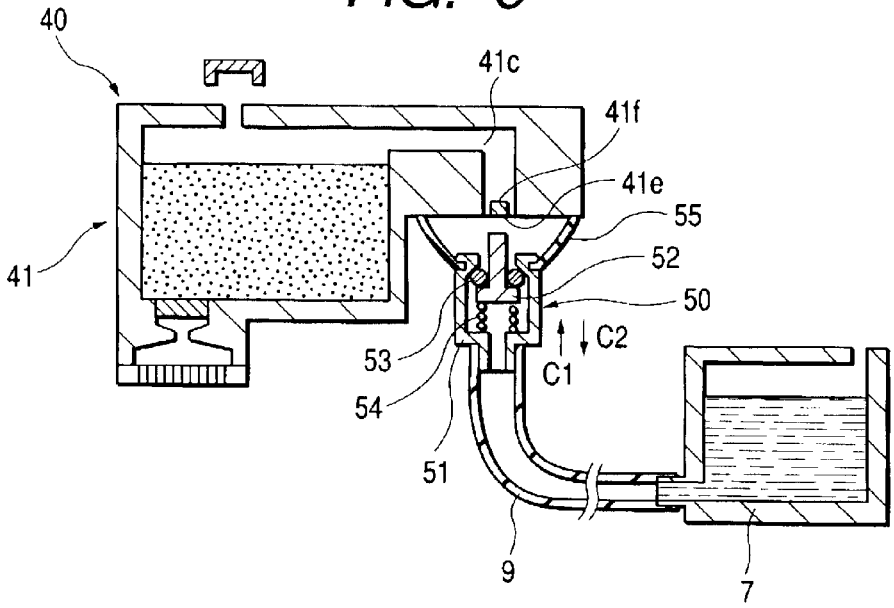
FIG. 6 is a sectional view corresponding to FIG. 3 at the sealed position according to the second embodiment of the present invention.

FIG. 6 is a sectional view corresponding to FIG. 3 at the sealed position according to the second embodiment of the present invention.

In the present embodiment, a joint portion 50 includes a joint base 51 disposed to be movable in the arrow C1 and C2 directions, a valve body 52 disposed to be movable in the directions of C1, C2 within the joint base 51, a spring 54 for urging the valve body 52 in the direction of C1, an O-ring 53 for sealing the joint base 51 and the valve body 52, and a cap 55 provided on an upper end portion of the joint base 51.

The joint base 51 acts as a supply tube, and an ink passage in the joint base is usually closed with the O-ring 53 closely contacted on an inner wall of the joint base 51 via the valve body 52 by the urging strength of the spring 54.

An upper end portion of the valve body 52 protrudes from the joint base 51, and an outer diameter thereof is smaller than an inner diameter of an ink inlet 41*e* which is an opening end of an ink flow path 41*c* provided in a sub-tank portion 41 of a head cartridge 40. Further, adjacent to the ink inlet 41*e* in the ink flow path, provided is a stopper 41*f* against the valve body 52 inserted from the ink inlet 41*e*. The cap 55 is made of the same material as the one used in the first embodiment, but has the shape of a sucker different from that of a bellows.

As the other configurations are the same as those described in the first embodiment, an explanation of them is omitted. Further, as to the main tank 7 and the tube 9, the same reference numerals as those in FIG. 2 are used.

In the following, ink supply operation from the main tank 7 into the sub-tank portion 41 in the present embodiment will be described.

First, the joint base 51 is raised up further from the sealed position shown in FIG. 6. When the joint base 51 is further raised up, the valve body 52 contacts the stopper 41*f*, and thereafter the valve body 52 is lowered relatively to the joint base 51 resisting the urging strength of the spring 34. Thereby, the main tank 7 and the sub-tank portion 41 are communicated with each other by opening of an ink passage in the joint base 51. Then, after the joint base 51 contacts the head cartridge 40, ink is supplied from the main tank 7 to the sub-tank portion 41 through the same manner as that in the first embodiment.

In the present embodiment, since the cap 55 has the shape of a sucker, the sealing characteristics between the joint portion 50 and the head cartridge 40 in the sealed position can be improved as compared with that in the first embodiment. Moreover, the cap 55 in the shape of a sucker can be applicable even when the interior of the joint base has the same configurations as those in the first embodiment. The cap 55 may have the shape of a bellows like that in the first embodiment.

(The Third Embodiment)

Figure 7:
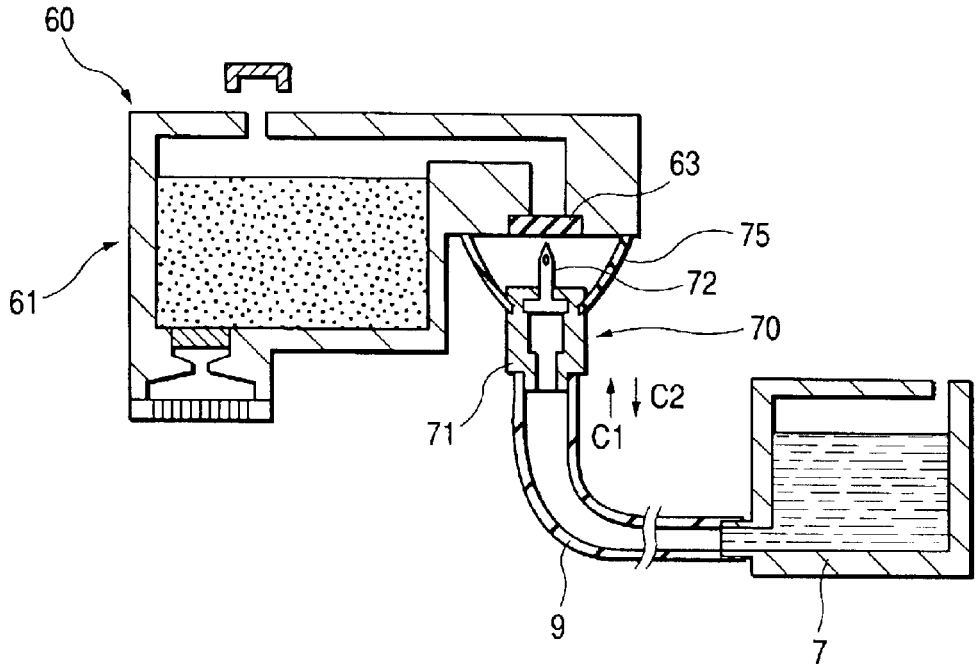
FIG. 7 is a sectional view corresponding to FIG. 3 at the sealed position according to the third embodiment of the present invention.
Figure 8:
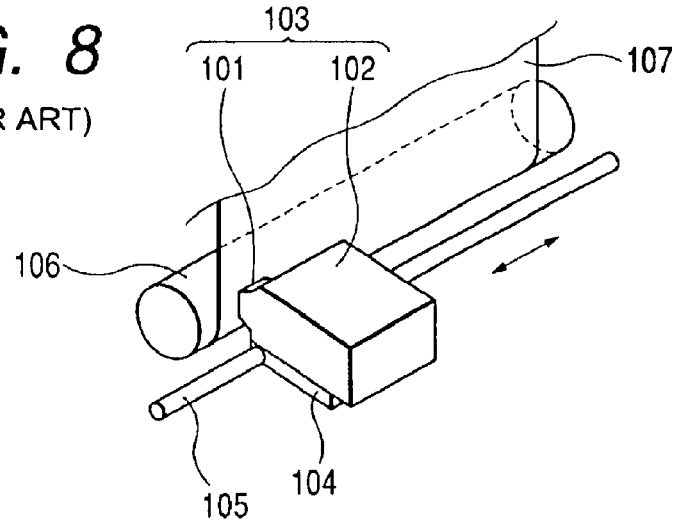
FIG. 8 (PRIOR ART)
FIG. 8 is a perspective view of a main portion of an inkjet recording apparatus according to the conventional head cartridge system.
Figure 9:
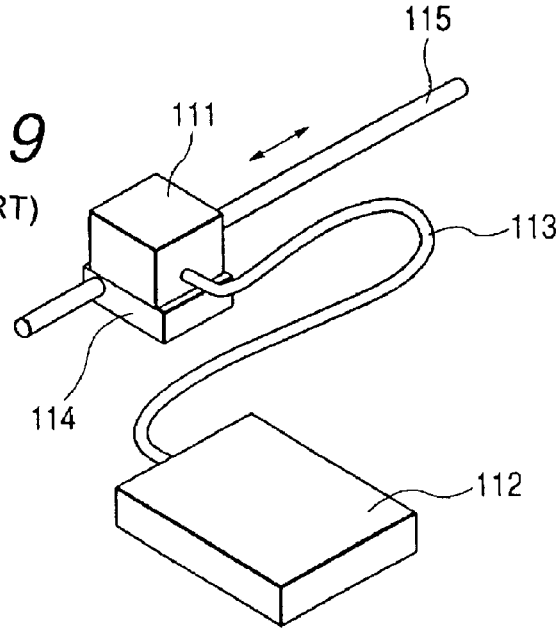
FIG. 9 (PRIOR ART)
FIG. 9 is a perspective view of a main portion of an inkjet recording apparatus according to the conventional tank cartridge system.
Figure 10:
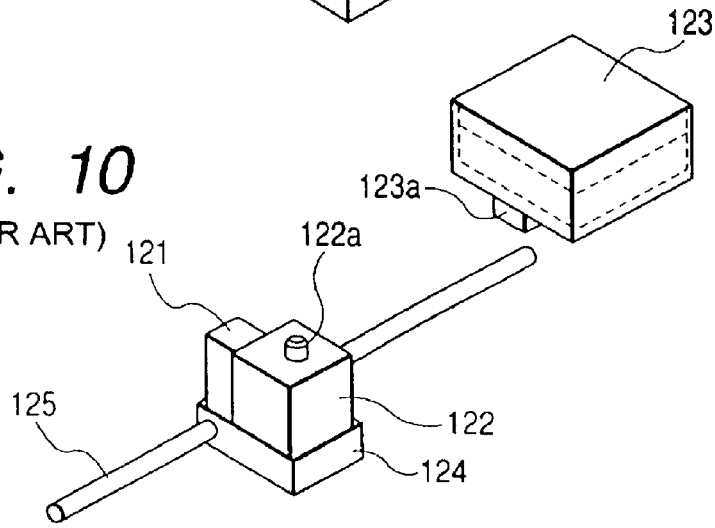
FIG. 10 (PRIOR ART)
FIG. 10 is a perspective view of a main portion of an inkjet recording apparatus according to the conventional pit-in system.

FIG. 7 is a sectional view corresponding to FIG. 3 at the sealed position according to the third embodiment of the present invention.

In the present embodiment, a joint portion 70 includes a joint base 71 with a supply needle 72, disposed to be movable in the arrow C1 and C2 directions, and a cap 75 provided on an upper end portion of the joint base 71. The supply needle 72 is a hollow needle with a hole formed at the top end portion thereof, and is provided to protrude from an upper end of the joint base 71. A main tank 7 and a hollow interior of the supply needle 72 are communicated with each other via a tube 9 and the joint base 71. The cap 75 has the shape of a sucker like that of the second embodiment.

On the other hand, a head cartridge 60 has the same configurations as those described in the first embodiment except that a plug 63, to be connected to the joint portion 70, with no slit formed thereon is used.

For supplying ink from the main tank 7 into a sub-tank portion 61, the joint portion 70 is raised up from the sealed position shown in FIG. 7, and the joint portion 70 and the sub-tank 61 are communicated with each other by means of piercing the plug 63 with the supply needle 72.

The configurations of the joint portion 70 can be simplified by employing such a configuration that the join portion 70 and the sub-tank portion 61 are communicated each other by piercing the plug 63 with the supply needle 72, because the joint portion 70 is not required to have a function as a valve. Further, since the cap 75 has the shape of a sucker, the sealing characteristics between the joint portion 70 and the head cartridge 60 in the sealed position can be improved as compared with that in the first embodiment. Also, in the present embodiment, the cap 75 may have the shape of a bellows like that in the first embodiment.

As described above, according to the above embodiments, a cap member for sealing a region between a connection portion of a second ink tank and a joint portion at a connected position and a disconnected position is provided in the joint portion, whereby invasion of foreign materials into an ink path can be prevented when the joint portion and the second ink tank are connected to each other, and adherence of ink in the joint portion can also be prevented. Accordingly, reliability of ink supply from a first ink tank to the second ink tank can be enhanced.

What is claimed is:

1. An ink supply mechanism comprising:

a first ink tank for storing ink;

a joint portion connected to said first ink tank;

a second ink tank disposed to be movable to said first ink tank;

a connection portion provided in said second ink tank, and connected to said joint portion in order to make ink supply from said first ink tank possible, wherein said joint portion is movable between a connected position where said connection portion is connected thereto and a disconnected position where said connection portion is not connected thereto, in a direction intersecting with a moving direction of said second ink tank, and said joint portion is provided with a cap member for sealing a region between said connection portion and said joint portion at said connected position;

wherein said joint portion comprises a joint base disposed to be able to contact with and separate from said second ink tank; a supply tube provided within the joint base so as to be movable in the same direction as that of the joint base and so that an end portion on said second ink tank side may be protruded from said joint base; a spring for urging the supply tube in the direction approaching said second ink tank; and a joint plug disposed nearer to said first ink tank than said supply tube in said joint base and having a built-in slit through which said supply tube can be inserted and drawn out, and wherein a second ink tank plug, through which said supply tube can be inserted and drawn out, for shutting off the interior of said second ink tank from the exterior, is provided at the connection portion of said second ink tank.

2. The ink supply mechanism according to claim 1, wherein said joint portion is movable to a position where said cap member does not seal the region between said connection portion and said joint portion.

3. The ink supply mechanism according to claim 1, wherein said cap member has the shape of a bellows.

4. The ink supply mechanism according to claim 1, wherein said cap member has the shape of a sucker.

5. The ink supply mechanism according to claim 1, wherein the urging strength of said spring is larger than a repulsive force applied by said second ink tank plug when said supply tube is inserted through the slit of said second ink tank plug.

6. The ink supply mechanism according to claim 1, wherein said joint portion includes a valve means which operates so as to communicate said first ink tank with said second ink tank while the joint portion is connected to said second ink tank.

7. The ink supply mechanism according to claim 1, wherein a second ink tank plug for shutting off the interior of said second ink tank from the exterior is provided at the connection portion of said second ink tank, and said joint portion includes a hollow supply needle which is able to pass through said second ink tank plug.

8. An ink jet recording apparatus for recording by means of discharging ink onto a record sheet from a recording head comprising:

a first ink tank provided in the recording apparatus for storing ink;

a joint portion connected to said first ink tank;

a second ink tank disposed to be movable against said first ink tank;

a connection portion provided in said second ink tank and connected to said joint portion in order to make ink supply from said first ink tank possible; and a carriage for reciprocating with the recording head and said second ink tank mounted thereon, wherein said joint portion is movable between a connected position where said connection portion is connected thereto and a disconnected position where said connection portion is not connected thereto, in a direction intersecting with a moving direction of said second ink tank, and said joint portion is provided with a cap member for sealing a region between said connection portion and said joint portion at said connected position;

wherein said joint portion comprises a joint base disposed to be able to contact with and separate from said second ink tank; a supply tube provided within the joint base so as to be movable in the same direction as that of the joint base and so that an end portion on said second ink tank side may be protruded from said joint base; a spring for urging the supply tube in the direction approaching said second ink tank; and a joint plug disposed nearer to said first ink tank than said supply tube in said joint base and having a built-in slit through which said supply tube can be inserted and drawn out, and wherein a second ink tank plug, through which said supply tube can be inserted and drawn out, for shutting off the interior of said second ink tank from the exterior, is provided at the connection portion of said second ink tank.

9. An ink supply mechanism comprising:

a main tank for storing ink;

a joint portion connected to said main tank;

a sub tank disposed to be movable to said main tank; and a connection portion provided in said sub tank, and connected to said joint portion in order to make ink supply from said main tank possible, wherein said joint portion is movable between a connected position where said connection portion is connected thereto and a disconnected position where said connection portion is not connected thereto, in a direction intersecting with a moving direction of said sub tank, and said joint portion is provided with a cap member for sealing a region between said connection portion and said joint portion at said connected position;

wherein said joint portion comprises a joint base disposed to be able to contact with and separate from said second ink tank; a supply tube provided within the joint base so as to be movable in the same direction as that of the joint base and so that an end portion on said second ink tank side may be protruded from said joint base; a spring for urging the supply tube in the direction approaching said second ink tank; and a joint plug disposed nearer to said first ink tank than said supply tube in said joint base and having a built-in slit through which said supply tube can be inserted and drawn out, and wherein a second ink tank plug, through which said supply tube can be inserted and drawn out, for shutting off the interior of said second ink tank from the exterior, is provided at the connection portion of said second ink tank.

10. An ink jet recording apparatus for recording by means for discharging ink onto a record sheet from a recording head comprising:

a main tank provided in the recording apparatus for storing ink;

a joint portion connected to said main tank;

a sub tank disposed to be movable against said main tank;

a connection portion provided in said sub tank, and connected to said joint portion in order to make ink supply from aid main tank possible; and a carriage for reciprocating with the recording head and said sub tank mounted thereon, wherein said joint portion is movable between a connected position where said connection portion is connected thereto and a disconnected position where said connection portion is not connected thereto, in a direction intersecting with a moving direction of said sub tank, and said joint portion is provided with a cap member for sealing a region between said connection portion and said joint portion at said connected position;

wherein said joint portion comprises a joint base disposed to be able to contact with and separate from said second ink tank; a supply tube provided within the joint base so as to be movable in the same direction as that of the joint base and so that an end portion on said second ink tank side may be protruded from said joint base; a spring for urging the supply tube in the direction approaching said second ink tank; and a joint plug disposed nearer to said first ink tank than said supply tube in said joint base and having a built-in slit through which said supply tube can be inserted and drawn out, and wherein a second ink tank plug, through which said supply tube can be inserted and drawn out, for shutting off the interior of said second ink tank from the exterior, is provided at the connection portion of said second ink tank.

* * * * *